United States Patent [19]

Farrell

[11] 4,249,103

[45] Feb. 3, 1981

[54] BREECH-ASSEMBLED IGNITER DEVICE

[75] Inventor: Thomas D. Farrell, Clifton Park, N.Y.

[73] Assignee: General Electric Company, Schenectady, N.Y.

[21] Appl. No.: 8,935

[22] Filed: Feb. 2, 1979

[51] Int. Cl.[3] ..... H01T 13/02; H01T 13/56

[52] U.S. Cl. ..... 313/135; 313/136

[58] Field of Search ..... 313/122, 136, 135

[56] References Cited

U.S. PATENT DOCUMENTS 2,351,543 6/1944 Race ..... 313/135 X

*Primary Examiner*—Robert Segal

*Attorney, Agent, or Firm*—Jerome C. Squillaro

[57] ABSTRACT

An electrical igniter device for a combustion apparatus such as a gas turbine comprises a unitary tubular conductive shell into which an assembly of coaxially arranged ingniter components are breech loaded. A spark electrode and a terminal extension are positioned in electrical contact within a hollow electrode insulator in the assembly. The electrode insulator is longitudinally positioned in the device between an internal shoulder in the shell and a removable retaining sleeve. The retaining sleeve is in turn held in position against the electrode insulator by an end coupling which is threaded into the breech end of the shell. An external lead connected to the end coupling transmits an electrical charge through the coupling to the shell. Inwardly extending tabs formed off the end of the shell opposite the breech end, together with the spark electrode within the shell, define a spark gap. A second external lead concentric with the end coupling conducts an opposite charge to the terminal extension and through it to the spark electrode.

1 Claim, 2 Drawing Figures

BREECH-ASSEMBLED IGNITER DEVICE

BACKGROUND OF THE INVENTION

This invention relates generally to igniter devices for combustion apparatus, and more particularly to igniter devices for use in gas turbine systems.

At a minimum, igniter devices of this type must be capable of initiating a combustion process within a chamber containing a combustible mixture. Igniter devices have commonly accomplished this function by producing an electrical spark across a gap formed between oppositely charged shell and spark electrode elements of a device. The spark so produced is sufficient to ignite a combustible mixture present in the combustion chamber.

Additionally, and inasmuch as they operate in very severe environments, igniter devices must be capable of protecting their internal components while also allowing loading and removal of such components for inspection and replacement as needed. Previously this has been accomplished by using elongated outer shells which protectively surrounded all of the internal components and which were constructed of two or more coaxial sections threadedly joined together.

However, certain problems involving internal component containment were encountered when igniter devices of the elongated multi-sectioned shell design were utilized in combustion apparatus. Specifically, in operation the sections of these devices have sometimes separated resulting in the release of internal components into the combustion apparatus where they have caused damage. Additionally, assembly and removal of internal components for inspection and replacement necessitated separating the sections comprising the shell and caused difficulties in reassembling parts in the sections and rejoining the sections to complete the shell.

Accordingly, an object of the present invention is to provide a new and improved igniter device for combustion apparatus.

Another object of the present invention is to provide a new and improved electrical igniter device which affords protection to its internal igniter components throughout their lengths.

Another object of the present invention is to provide an igniter device having a new and improved unitary shell construction effective for insuring secure containment of igniter components.

Another object of the present invention is to provide a new and improved breech-loaded igniter device.

Still another object of the present invention is to provide a breech-loaded igniter device including a new and improved electrode assembly and closure arrangement for predeterminedly positioning the internal components of the device and for facilitating assembly and replacement of such components.

SUMMARY OF THE INVENTION

The above and other objects and advantages are achieved in an electrical igniter device comprising a unitary conductive shell into which all of the internal igniter components are removably breech-loaded and assembled in an arrangement in which such internal components are protected over their entire lengths. Additionally, in such an arrangement the internal components are retained in predetermined operative positions by means of a series of abutments and cooperating cylindrical retaining and insulating sleeves. Furthermore, an end coupling engaged with the unitary shell cooperates with the mentioned sleeves to secure them removably in their predetermined operative positions.

DESCRIPTION OF THE INVENTION

Figure 1:
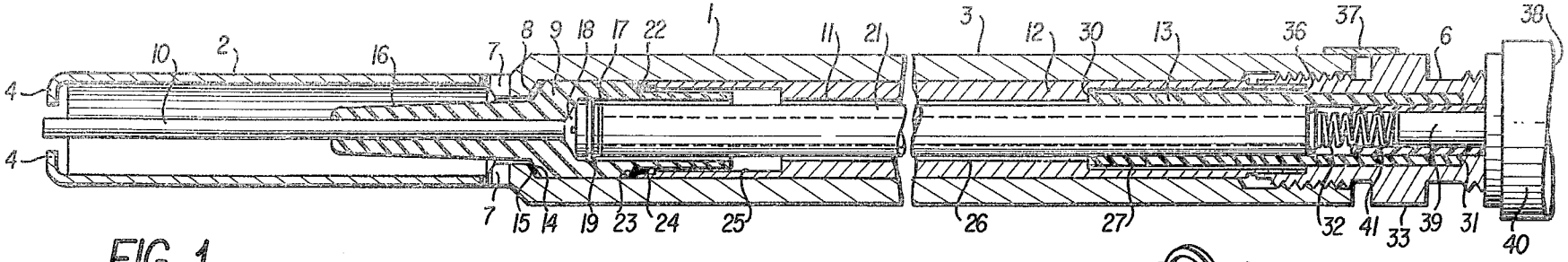
FIG. 1 is a longitudinal sectional view of an igniter device constructed in accordance with an embodiment of the present invention.
Figure 2:
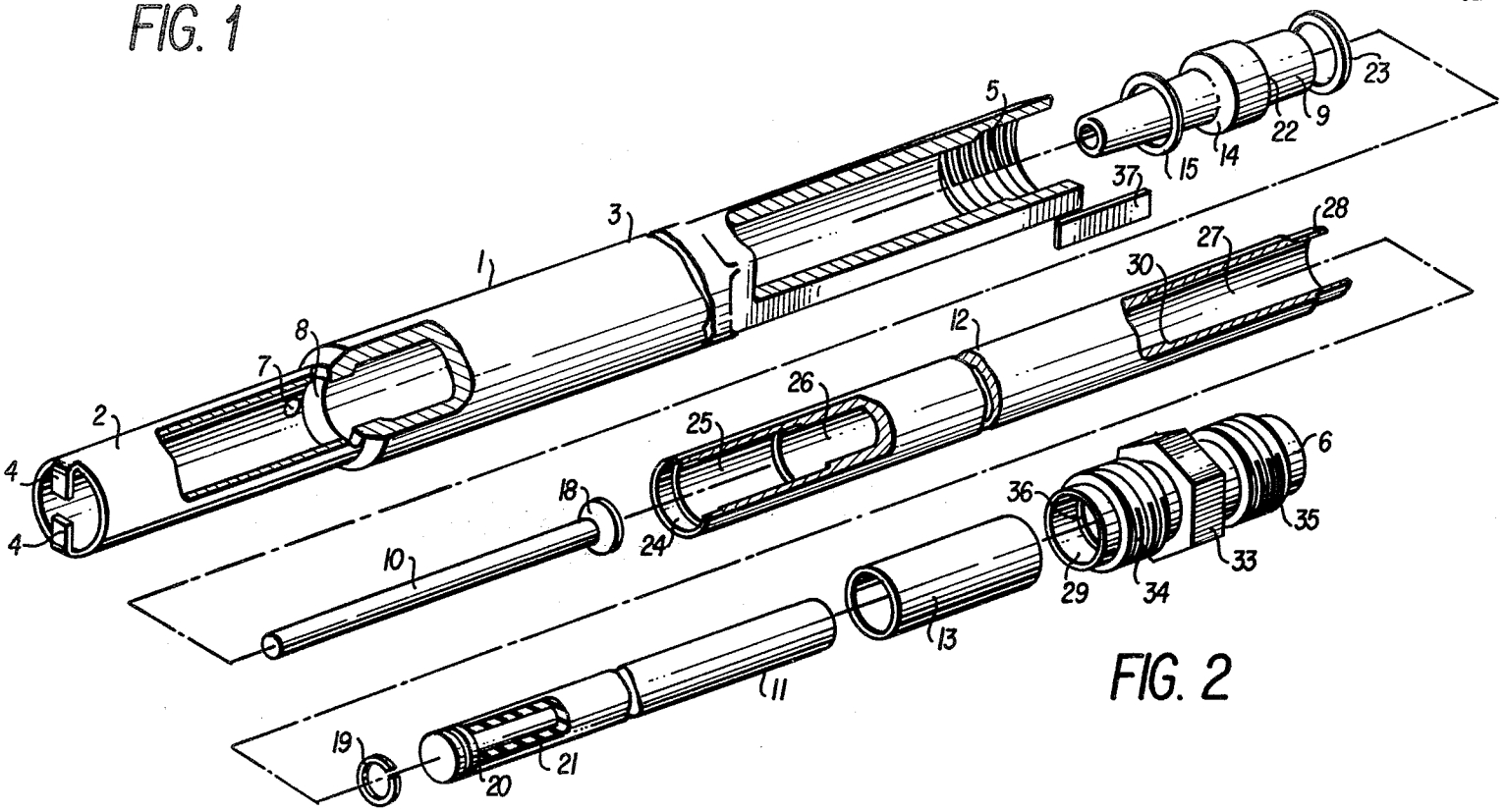
FIG. 2 is an exploded perspective view of the igniter device of FIG. 1 with portions of components thereof broken away to show certain internal constructions of the device.

The invention as exemplified by the embodiment illustrated in the drawing includes a unitary conductive tubular shell 1 having a spark electrode section 2 and a body section 3. As seen in FIG. 1, the spark electrode section 2 is cylindrical and is of a reduced diameter and has a thinner wall section compared to the body section 3.

At the outer end of the spark electrode section 2 are located a plurality of inwardly extending integral tabs 4. The opposite or breech end 5 of the body section 3 is internally threaded to receive an externally threaded end coupling 6. In this arrangement, the end coupling 6 is removably secured to the breech end of shell 1. Adjacent the juncture of the spark electrode section 2 and the body section 3, the shell 1 is provided with a plurality of vents 7 and with an internal shoulder 8. The shoulder 8 is provided to limit insertion of an electrode assembly which is positioned in the body section and comprises several coaxially arranged conductive and insulative components including an electrode insulator 9 and an elongated spark electrode 10, both of which have end portions extending past the shoulder 8 and into the spark electrode section 2.

The electrode assembly further comprises a terminal extension 11, a retaining sleeve 12 and an insulative sleeve 13, all of which are coaxially arranged and are longitudinally positioned in an arrangement of cooperating components described in detail hereinafter.

The several parts comprising the electrode assembly are predeterminedly longitudinally positioned relative to each other, and the assembly as a whole is predeterminedly positioned in the shell by a unique cooperation of parts and shoulder abutments. More specifically, the electrode assembly is predeterminedly longitudinally positioned within the shell 1 by the abutment of a shoulder 14 on the electrode insulator 9 against the internal shoulder 8, with a suitable gas sealing washer 15 positioned therebetween. Formed in the electrode insulator 9 is a central bore 16 with a counter-bored section 17. An enlarged head 18 of the spark electrode 10 is positioned in the counter-bore of insulator 9. Extending into the counter-bore 17 and making physical and electrical contact with the head 18 of the spark electrode 10 is the terminal extension 11. The terminal extension 11 is removaly coupled to the electrode insulator 9 by the frictional engagement of a compressed metal split ring 19 with the wall of the counter-bore 17, whereby the terminal extension 11 is held in a coaxial position in the assembly as the compressed split ring 19 is seated in an annular depression 20 formed on an end of the terminal extension 11. Additionally, the terminal extension 11 is covered, except for its end surfaces, by an insulative ceramic coating 21 effective for isolating it electrically from the surrounding conductive retaining sleeve 12.

The length of the retaining sleeve 12 is predeterminedly established such that in its operative position its inner end abuts a suitable washer 22 seated on an external shoulder 23 formed on the electrode insulator 9. The electrode insulator 9 is thereby held in its proper longitudinal position within the shell 1 such that the outer end of the spark electrode 10 defines a pair of spark gaps with the tabs 4 of the shell 1.

In order to provide sufficient clearances between coaxial components the bore of the retaining sleeve 12 comprises several sections of different diameters corresponding in size and in axial location to certain sections of those components surrounded by the retaining sleeve 12, such as at 24, 25, 26 and 27. Similarly, the exterior of the retaining sleeve 12 is of reduced diameter at 28 in order to provide sufficient clearance for reception in a counter bore 29 in the end coupling 6.

The innermost section of the insulative sleeve 13 is surrounded by the retaining sleeve 12. Additionally, the insulative sleeve 13 fits over a portion of the terminal extension 11 and is longitudinally positioned within the body section 3 of the shell 1 by cooperative engagement between a shoulder 30 formed by the retaining sleeve counter-bore 27, and an internal shoulder 31 formed in the end coupling 6. The insulative sleeve 13 maintains an end of the terminal extension 11 in a concentric relationship with the shell 1, while also electrically isolating the end coupling 6 from the terminal extension 11 and a conductive spring 32, the purpose for which will be described hereinafter.

The end coupling 6 is formed with a non-circular wrench engaging part or nut head 33 disposed between externally threaded nipple portions 34 and 35. The nipple portion 34 is threadedly engageable with the internally threaded breech end 5 of shell 1. In this manner, the end coupling 6 can be adjustably tightened into a position in which an internal shoulder 36 former therein precisely abuts the retaining sleeve 11 for thereby moving the retaining sleeve 11 into a position wherein it is effective to hold the electrode insulator 9 in a predetermined position against the internal shell shoulder 8. In this position when the spark electrode 10 is seated in the electrode insulator 9, the outer end of the spark electrode is located immediately adjacent the tabs 4 of the shell 1, for thusly defining a spark gap. A locking tab 37 is tack welded in place between the end coupling 6 and the shell 1 in order to secure the end coupling 6 rotationally, and specifically to secure its internal shoulders 31 and 36 in their proper longitudinal positions with respect to the insulative sleeve 13 and the retaining sleeve 11, respectively.

An electrical charge required to generate a spark across the spark gap is provided by a suitable external electrical connector 38, which can be internally threaded for securement to the end coupling nipple 35. As shown in FIG. 1, the electrical connector 38 contains a central electrode 39 insulated from an oppositely charged outer cap 40 by a ceramic lining 41. The central electrode 39 extends through the hollow end coupling 6 and transmits an electrical charge to the terminal extension 11 by means of a conductive spring 32. The variable length of the spring 32 provides a positive electrical contact to the terminal extension over a relatively wide range of positional interrelationships among the end coupling 6, the shell 1 and the electrical connector 38. The insulative sleeve 13 and the ceramic lining 41 provide proper electrical insulation for this connection.

In operation, an electrical charge is transmitted from the central electrode 39 through the conductive spring 32 to the terminal extension 11. The charge is then transmitted to the spark electrode 10 through the inner contacting end of the terminal extension within the electrode insulator 9. An opposite electrical charge is transferred from the electrical connector outer cap 40 through the end coupling 6 to the shell 1, and thus to the tabs 4 integral therewith. In this manner, a spark is generated across the gap formed between the oppositely charged tabs 4 and the spark electrode 10. When the igniter is positioned within a combustion chamber of an apparatus such as a gas turbine, this spark functions to ignite a self-sustaining combustion therein.

Thus it will be seen from the foregoing that the present invention enables the use of a unitary shell construction, thereby avoiding those problems attendant the use of a multi-sectioned shell wherein shell sections can become detached and allow igniter device components to enter the internal regions of a combustion apparatus. Additionally, this arrangement adequately protects all internal components during operation, and enables and facilitates loading and replacement of internal electrode assembly components from the outer or breech end of the device.

The above-described embodiment of this invention is intended to be exemplative only and not limiting, and it will be appreciated from the foregoing by those skilled in the art that many substitutions, alterations and changes may be made to the disclosed structure without departing from the fundamental concept of the invention.

What is claimed as new and desired to be secured by Letters Patent of the United States is:

1. A breech-assembled igniter device comprising:

a unitary conductive tubular shell having body and spark electrode sections disposed at opposite ends thereof, an internal shoulder adjacent the juncture of said sections, inwardly extending tabs on the outer end of said electrode section, and an internal thread at the breech end of said body section.

an electrode assembly removably positioned in said shell and comprising an electrode insulator positioned in said shell and having a counter-bored central bore, a pair of longitudinally spaced external shoulders one of which abuts said internal shoulder adjacent said juncture, an elongated spark electrode held in said central bore of said electrode insulator and protruding from the end thereof to the end of said spark electrode section of said shell for defining a spark gap with said tabs, a terminal extension bearing an insulative coating and positioned in said shell with an end retained in the counter-bore of said electrode insulator in electrical contact with the inner end of said shell about said spark electrode, a retaining sleeve positioned in said shell about said terminal extension and engaging the other of said shoulders on said electrode insulator for positioning said electrode insulator against said internal shoulder in said shell, said retaining sleeve having an intermediately located internal shoulder, and an insulative sleeve positioned between said terminal extension and said retaining sleeve, and abutting said internal shoulder therein for being predeterminedly located in said electrode assembly with the outer end of said insulative sleeve positioned outwardly of the outer end of said terminal extension, and an end coupling threadedly positioned in the breech end of the body section of said shell and bearing on the outer end of said retaining sleeve for holding same and said electrode insulator in operative positions and for capturing said insulative sleeve in a predetermined position in said electrode assembly, and said coupling being removable for enabling breech assembly and disassembly of parts in said shell, being externally threaded for enabling an electrical connection thereto, and being tubular for permitting electrical connection therethrough to said terminal extension.

* * * * *